US008302954B2

(12) United States Patent
Merkli

(10) Patent No.: US 8,302,954 B2
(45) Date of Patent: Nov. 6, 2012

(54) SHEET FEEDER FOR FEEDING PRINTED SHEETS TO A CONVEYING DEVICE

(75) Inventor: Peter Merkli, Oftringen (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 12/381,670

(22) Filed: Mar. 13, 2009

(65) Prior Publication Data

US 2009/0236793 A1 Sep. 24, 2009

(30) Foreign Application Priority Data

Mar. 13, 2008 (EP) ..... 08 405 070

(51) Int. Cl.
*B65H 1/22* (2006.01)

(52) U.S. Cl. ..... 271/37; 271/112; 271/277

(58) Field of Classification Search ..... 271/277, 271/69, 306, 314, 315, 82, 182, 3.21, 3.24, 271/187, 100, 37, 112, 266, 270; 270/52.27, 270/52.26, 52.29; 198/470.1
See application file for complete search history.

(56) References Cited

U.S. PATENT DOCUMENTS

| | | | | |
|---|---|---|---|---|
| 4,491,311 | A * | 1/1985 | Glanzmann | 270/52.27 |
| 5,794,930 | A * | 8/1998 | Glanzmann et al. | 271/277 |
| 5,921,546 | A * | 7/1999 | Herman | 271/270 |
| 6,224,050 | B1 * | 5/2001 | Wicki | 271/37 |
| 6,308,945 | B1 * | 10/2001 | Sagesser | 270/52.27 |
| 6,375,179 | B1 * | 4/2002 | Boss et al. | 270/52.27 |

FOREIGN PATENT DOCUMENTS

| | | |
|---|---|---|
| DE | 198 21 022 | 12/1998 |
| DE | 197 38 920 | 3/1999 |
| EP | 0 716 995 | 6/1996 |
| FR | 1 154 053 | 4/1958 |

* cited by examiner

*Primary Examiner* — Kaitlin Joerger
(74) *Attorney, Agent, or Firm* — Lucas & Mercanti, LLP; Klaus P. Stoffel

(57) ABSTRACT

A sheet feeder for feeding printed sheets to a conveying device, with a gripper drum that has at least one gripper for removing the printed sheets one at a time from a stack; a pocket is permanently mounted essentially in the peripheral area of the gripper drum wherein the printed sheets are aligned against a stop with the fold forward and set down on the conveying device with reversal of direction; and with a decelerating device for slowing the speed of the printed sheets downstream towards the stop. The decelerating device has at least one secondary stop, which rotates in the same direction as the gripper drum, has a slower speed than the gripper drum for slowing down the printed sheets, and on which the printed sheets are slowed down upstream of the stop.

13 Claims, 5 Drawing Sheets

SHEET FEEDER FOR FEEDING PRINTED SHEETS TO A CONVEYING DEVICE

BACKGROUND OF THE INVENTION

1. Field of the Invention

The present invention relates to a sheet feeder for feeding printed sheets to a conveying device. The sheet feeder has a gripper drum with at least one gripper for removing the printed sheets one at a time from a stack; a pocket, which is permanently mounted essentially in the peripheral area of the gripper drum and in which the printed sheets can be aligned against a stop with the fold forward and set down on the conveying device with reversal of direction; and a decelerating device, which slows the speed of the printed sheets downstream towards the stop.

2. Description of the Related Art

Sheet feeders of this type are known especially as signature feeders of gathering and stitching machines. These have a gripper drum, with which printed sheets in a stack are tipped at a front edge, gripped and guided one at a time to stops, also known as register stops, on which the printed sheets are aligned. During this process, the sheets are held in the peripheral area of the drum by guides, which form a pocket and are mounted in a stationary way. The printed sheets are pulled from this pocket one at a time by their rear edges and opened with opening drums. They are then set down in roof-like fashion on a gathering line.

The printed sheets are often provided with an overlay fold to allow them to be opened. The different length of the front side and rear side of the folded printed sheets thus allows central opening. During the further processing of the gathered printed sheets, these overlay folds must be cut off in a cutting device to realize a clean appearance of the printed products. The overlay fold thus serves only for correct processing of the printed sheets and ultimately winds up as waste, which, of course, must be kept low. Conflicting with this goal is the fact that in a high-speed sheet feeder, the printed sheets strike at high speed in the pocket and do not have time to stabilize in this position. Especially the end of the printed sheet that is located in the pocket thus lies unsteadily and inexactly, which makes it more difficult to realize reliable gripping and opening with the smaller overlay fold that is desired. Therefore, in high-capacity sheet feeders, the overlay fold must be made longer than would be desirable from the standpoint of waste production.

To stabilize the printed sheets in the pocket, the sheet feeder disclosed by EP 0 716 995 A has a pocket with a rubber stop, which is meant to dampen the impact of the printed sheets. In the sheet feeder described by DE 197 38 920 A, an endless belt is provided, which is intended to stabilize the printed sheets in the pocket with frictional contact.

SUMMARY OF THE INVENTION

The object of the invention is to create a sheet feeder of the aforementioned type, which is intended to allow reliable gripping and opening of the sheets at their rear edge at high processing speeds.

In a sheet feeder of this general type, the solution to this problem is provided by the fact that the decelerating device has at least one secondary stop, which rotates in the same direction as the gripper drum, has a slower speed than the gripper drum for slowing down the printed sheets, and on which the printed sheets are slowed down upstream of the stop.

In the sheet feeder of the invention, the printed sheets are slowed down significantly by the secondary stop before the stop is reached. The speed at which the printed sheets strike the stop in the pocket is thus significantly lower than the speed of the printed sheets after they have been pulled from the stack. Before the change in direction, the printed sheets are thus decelerated in two stages. The speed can be reduced, for example, by half on the secondary stop. Since the printed sheets strike the stop at a reduced speed in the pocket, the end of the sheet, i.e., the rear edge of the printed sheet, is positioned much more steadily and exactly. Therefore, the overlay fold can be made shorter, which reduces the amount of waste, since in most cases the overlay fold is cut off. Due to the lower speed of the printed sheets in the pocket, the rear edge or the overlay fold can thus be gripped more reliably, and the printed sheet can be opened. The stop in the pocket is also acoustically quieter, which is another advantage. The sheet feeder of the invention is thus quieter at the same output.

In accordance with a further development of the invention, it is provided that the one or more secondary stops bring the slowed printed sheet into the vicinity of the pocket. The printed sheet remains with its front edge on the secondary stop until it is slowed down on the stop. To this end, in accordance with another refinement of the invention, it is provided that the one or more secondary stops have holding means for gripping the front edge of the braked printed sheet. The front edge of the printed sheet can be gripped especially reliably if, in accordance with another refinement of the invention, the holding means have a spring element for gripping one printed sheet at a time. The front edge of the printed sheet can then be gripped on the secondary stop. This allows especially reliable transfer of the braked printed sheets to the pocket.

In accordance with another further development of the invention, it is provided that the one or more secondary stops are located on a lever. The lever allows simple and nevertheless reliable control of the secondary stop. This is especially simple and reliable if, in accordance with a further development of the invention, the lever is rotatably mounted on a driven disk. Preferably, two disks of this type are provided, with the gripper drum arranged between the two disks. Naturally, before the printed sheets strike the secondary stop, they are released. In this refinement, the printed sheets are thus slowed down on two levers arranged some distance apart.

In accordance with a further development of the invention, it is provided that the lever is a two-armed lever and that the one or more secondary stops are located at the rear end of the lever. The lever can be controlled, for example, by a cam disk. A suitable cam roller, which runs on the cam of the cam disk, is then mounted on the front end of the lever. Naturally, if there are two levers, two such cam disks can be provided accordingly. The cam disks are rigidly mounted.

In accordance with a further development of the invention, it is provided that the one or more secondary stops are controlled in such a way that they are swiveled into a position that is shifted back relative to the periphery of the gripper drum after the pocket with respect to the direction of flow and that they are swiveled to the periphery of the gripper drum before the pocket to slow down the printed sheets. In this connection, the secondary stop is preferably swiveled radially inward or radially outward. If the secondary stop is swiveled inward into an inactive position, the printed sheets can be moved past the secondary stop. If the secondary stop is swiveled into the peripheral area of the gripper drum, printed sheets which follow strike this secondary stop.

In accordance with a further development of the invention, at least two, preferably three, and even more preferably four or more than four secondary stops are provided, which are spaced apart from one another. They are preferably spaced equal distances apart.

In accordance with a further development of the invention, the secondary stop has a speed of rotation that is about 50% of the speed of rotation of the gripper drum. The speed of impact of the printed sheets on the stop of the pocket can thus be essentially halved.

In accordance with a further development of the invention, it is provided that at least one secondary stop can be swiveled outward upstream of the pocket in such a way that it deflects the trailing end of a preceding printed sheet radially outward. This secondary stop thus acts here not as a stop for slowing a printed sheet but rather as a guide device for guiding the rear edge into the intended position for the reversal of direction. The aforesaid end of the sheet is already being deflected outward by gravity. However, this deflection is guided by the secondary stop and thus takes place more precisely.

The printed sheets are preferably provided with a leading fold and are preferably so-called signatures. The sheet feeder of the invention preferably has opening drums, with which the printed sheets, after the aforesaid reversal of direction has occurred, are opened, so that they can be set down on the conveying device. However, this is not absolutely necessary. In principle, after the reversal of direction, the printed sheets can also be further conveyed unopened.

The sheet feeder of the invention is suitable especially for a gathering and stitching machine. However, use for a gathering and stitching machine is not absolutely necessary.

Other advantageous features are specified in the dependent claims and the following description and are apparent from the drawings.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING IN THE DRAWING

DETAILED DESCRIPTION OF THE INVENTION

Figure 1:
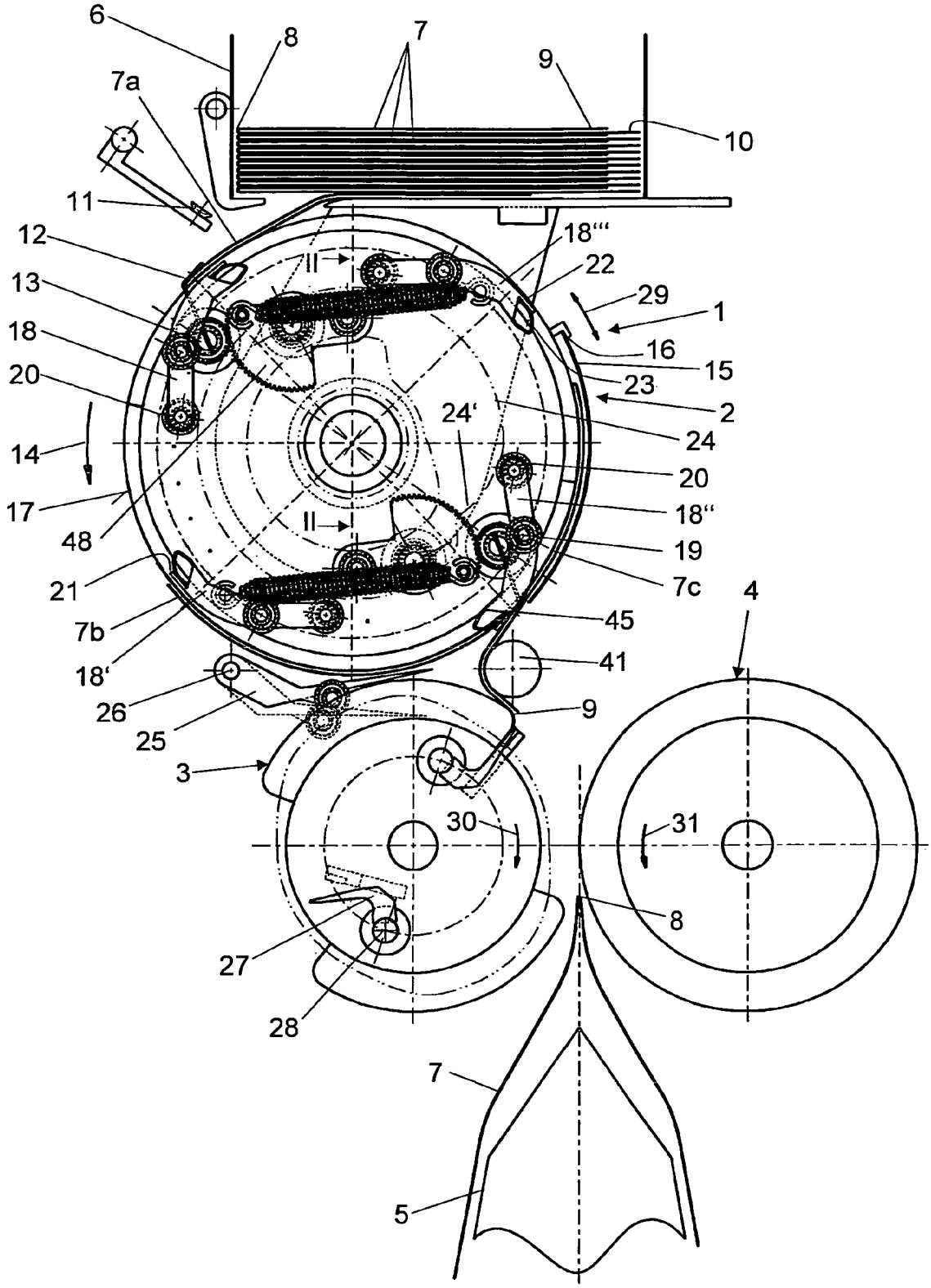
FIG. 1 is a schematic view of a sheet feeder of the invention.

The sheet feeder 1 shown in FIG. 1 has a gripper drum 2, with which printed sheets 7 are separated and removed from a stack 6 in a way which in itself is already well known. The printed sheets 7 are preferably signatures and have a front edge 8 and a rear edge 9. The printed sheet is usually folded at the front edge 8. The rear edge 9 is furnished with an overlay fold. To separate the printing sheets 7, a suction device 11 or other suitable type of gripping device is provided.

Figure 3:
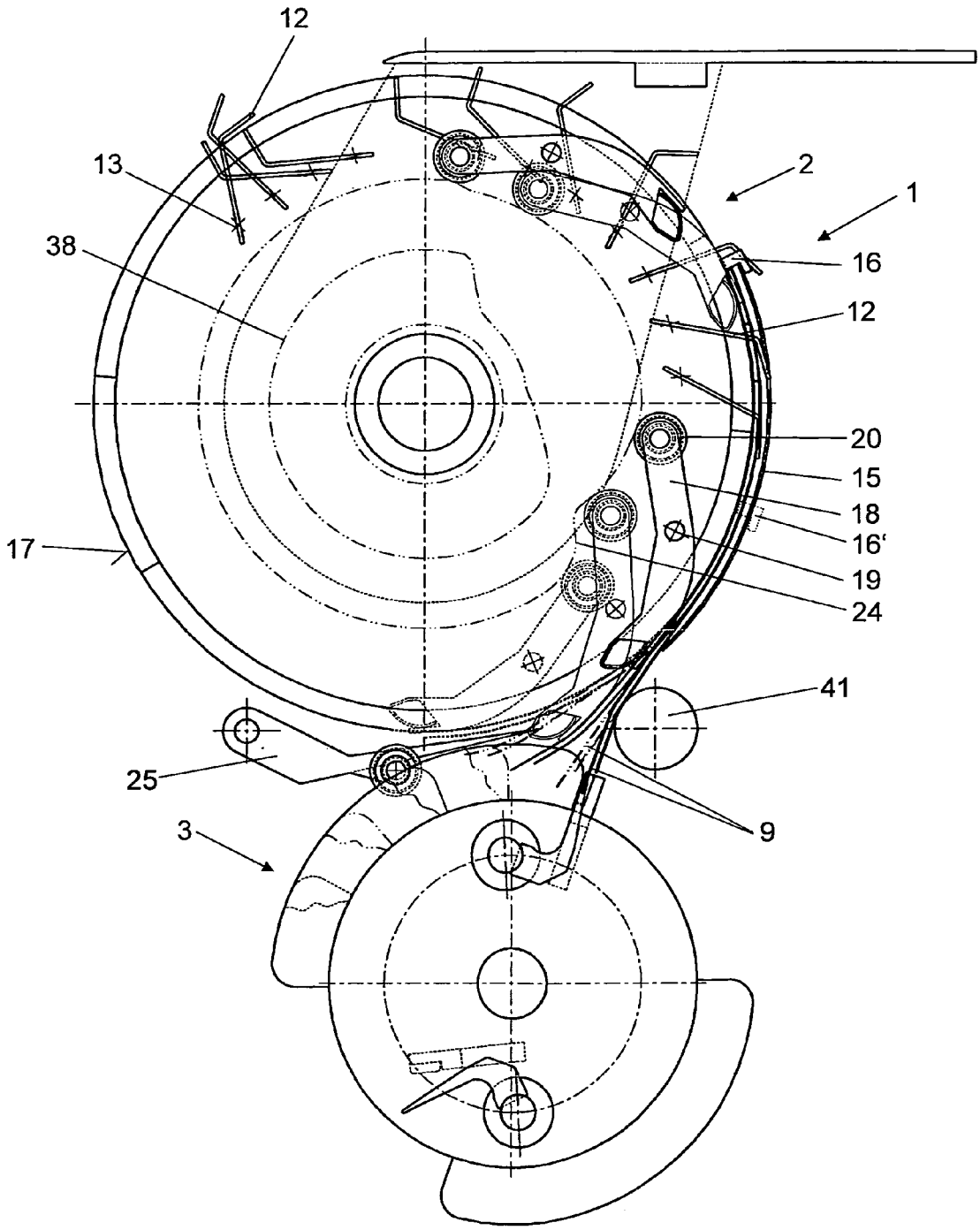
FIG. 3 is a schematic partial view of the sheet feeder of the invention.

The gripper drum 2 has several grippers 12 which in themselves are already well known. Each gripper 12 can be rotated about its axis 13 under automatic control. These grippers 12 seize each separated printed sheet 7 by its front edge and convey it on a peripheral area 17 formed by the gripper drum 2 in the direction of the arrow 14 and thus in the counterclockwise direction in FIG. 1. In a lower area of the gripper drum 2, a supporting lever 25 is installed, which can be swiveled about an axis of rotation 26 between the positions indicated by the solid lines and the broken lines. The supporting lever 25 serves to guide small formats. After this supporting lever 25, the printed sheets 7, with the folded front edge 8 forward, are fed into an essentially stationary pocket 15, which is formed by several guides. The pocket 15 is thus mounted on a frame, which is not shown here. In principle, however, the pocket 16 could also be provided with limited movement, so that, for example, if the printed sheets 7 become jammed, it could give way. A stop 16, which the front edges 8 of the printed sheets 7 strike, is located near the pocket 15. To accommodate different formats, the stop 16 can be shifted in the peripheral direction, as indicated by the double arrow 29. FIG. 3 shows a stop 16' that is adjusted for a comparatively small format.

If a printed sheet 7 is located in the stop position against the stop 16, it is seized at its rear edge 9 by a gripper 27 of an opening drum 3 and pulled out of the pocket 15 with reversal of its direction. The gripper 27 or the two grippers 27 that are provided here are swiveled about an axis 28 under automatic control. The opening drum 3 cooperates with another opening drum 4 to open the printed sheet gripped at its rear edge 9 and set it down on a gathering chain 5 or other conveying device. In this operation, the opening drums 3 and 4 are driven in the directions of the arrows 30 and 31. The gathering chain 5 is especially part of a gathering and stitching machine, the rest of which is not shown here. In principle, the gathering chain 5 can also be some other type of conveying device. The printed sheets 7 can also be dropped onto the conveying device unopened.

Figure 2:
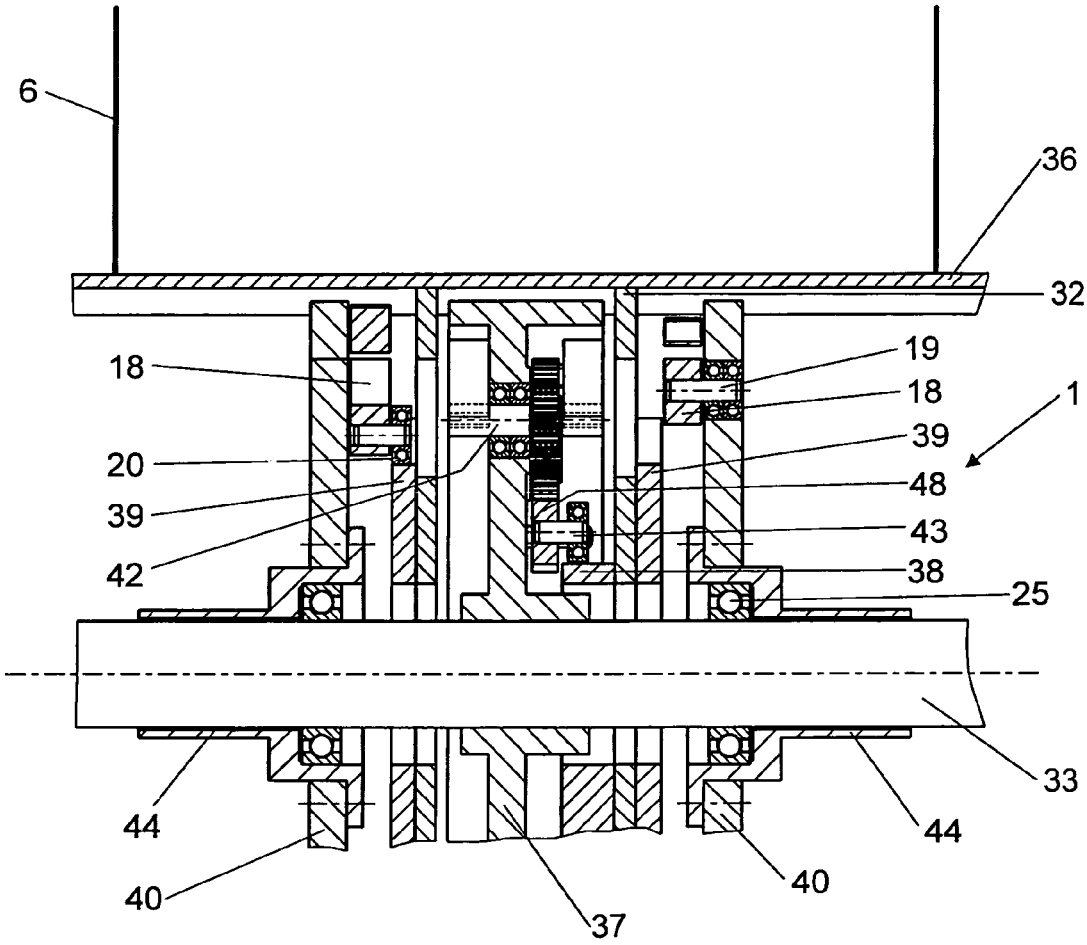
FIG. 2 is a cross section through part of the sheet feeder of the invention along line II-II of FIG. 1.

As FIG. 2 shows, the gripper drum 1 is mounted on a shaft 33, which is driven and controlled by a drive (not shown). A gripper disk 37 is mounted nonrotatably on this shaft 33, and the aforementioned grippers 12 are supported on the gripper disk 37 in such a way that they can rotate about an axis of rotation 13. The grippers 12 are controlled by a toothed segment 48 on a cam 38, on each of which a cam roller 43 rests. The cam 38 is mounted on a support 32, which is joined with a feeder table 36 or the machine frame. When the shaft 33 rotates, the grippers 12 are controlled in such a way that they seize or release a printed sheet 7 at the desired moment.

The gripper disk 37 is disposed between two secondary stop disks 40, each of which is nonrotatably joined with sleeves 44, which are arranged coaxially with the shaft. The sleeves 44 are synchronously driven by a drive (not shown here). It is also possible for the secondary stop disks to be driven by their own drive, for example, a servomotor. This makes it possible to optimize the sequence of motions of the secondary stops and/or to reduce the number of secondary stops. With a suitable gear ratio, this drive can simultaneously serve as the drive for the shaft 33. The secondary stop disks 40 each serve to support four levers 18, which, as shown in FIG. 1, are two-armed levers. As shown in FIG. 2, these levers 18 are each rotatably supported, with an axis of rotation 19, on one of the two secondary stop disks 40. At one end, each of the levers 18 has a cam roller 20, which runs on a cam 24 of a cam disk 39. The two cam disks 39 are also rigidly connected with the support 32. The course of the cam 24 is shown in FIG. 1 as a dot-dash line. Instead of a cam disk 39, other control mechanisms can also be used for controlling the levers 18.

Figure 4:
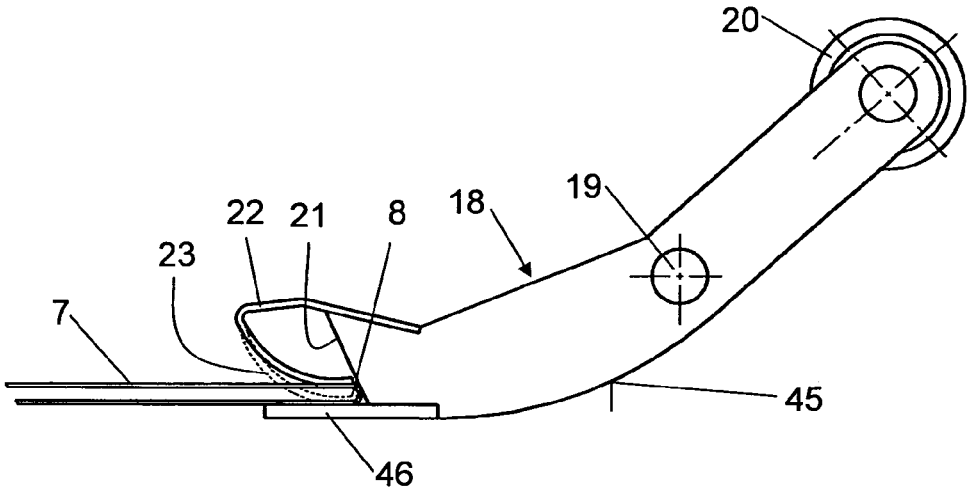
FIG. 4 is schematic view of a lever that forms a secondary stop.

In addition, the levers 18 have a secondary stop 21 at one end, as shown in FIGS. 1 and 4. The secondary stop 21 has a more or less conically tapering recess 23, which is bounded on one side by a spring element 22 and on the other side by a tongue 46. The spring element 22 is designed especially as a leaf spring. The recess 23 is arranged some distance from the axis of rotation 19 and at the opposite end of the lever 18 from the cam roller 20. Each two-armed lever 18 thus has the cam roller 20 at one end and the aforesaid secondary stop 21 at the other end. The spring element 22 and the tongue 46 form holding means, with which the decelerated printed sheet 7 can be seized by its front edge 8.

The two secondary stop disks 24 are driven in the same direction as the gripper disk 37. However, the speed of rotation of the two secondary stop disks 40 is slower than the speed of rotation of the gripper disk 37. If the gripper disk 37 is driven at a speed V, then the two secondary stop disks 40 are driven at a speed V'. The speed V' is significantly lower than the speed V. The two secondary stop disks 40 are driven at the same speed and synchronously with each other. In the illustrated embodiment, the speed V' is 50% of the speed V. However, other speed ratios are also possible here; in particular, the speed V can be varied by a controlled drive during a rotation of the secondary stop disks.

The cam 24 has an inwardly curved area 24', which is located approximately in the 4 o'clock position in FIG. 1. In this area 24', the cam rollers 20 thus move radially inward and then radially outward again. Accordingly, the secondary stop 21 first moves radially outward and then radially inward again. The outward movement causes the secondary stop 21 to enter the peripheral region 17, on which the printed sheets 7 are also being conveyed. The corresponding secondary stop 21 is now controlled in such a way that, upstream of the stop 16 or upstream of the pocket 15, it forms a stop for a printed sheet 7 trailing it.

Since the levers 18 are moved at a lower speed than the printed sheets 7, the aforementioned printed sheet 7 is slowed down on the secondary stop 21 to the speed of the secondary stop 21. Since, as explained earlier, two secondary stop disks 40 are provided, a printed sheet 7 simultaneously strikes two levers 18 or two secondary stops 21 that are some distance apart. Before the printed sheet 7 hits the two secondary stops 21, it is released by the corresponding gripper 12. The two levers 18, on which the printed sheet 7 is stopped, now guides this printed sheet 7 farther until it reaches the pocket 15, in which the printed sheet is finally slowed down to a speed of zero on the stop 16.

Figure 5:
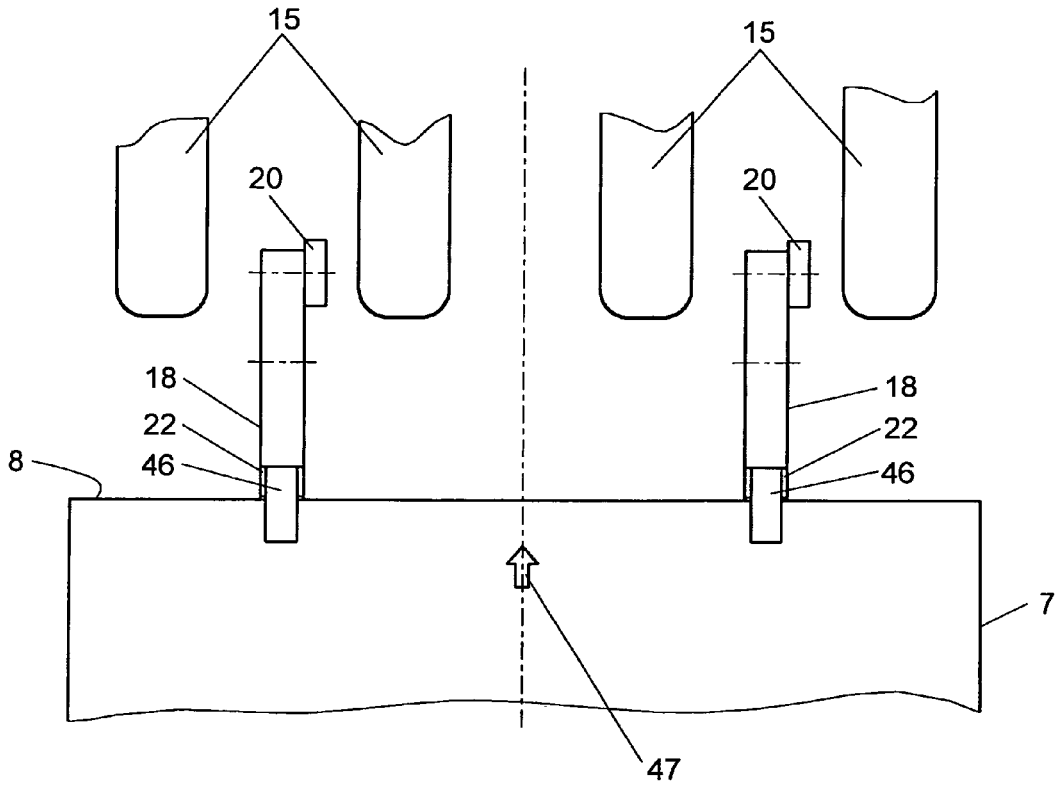
FIG. 5 shows schematically the transfer of a printed sheet to a bin.

If the front edge 8 of a printed sheet 7 runs into the two secondary stops 21, it then passes under the spring element 22 until finally, at the end of the recess 23, it is gripped by said spring element 22 and thus stabilized. This is shown in FIGS. 4 and 5. In this way, the slowed printed sheet 7 can be safely transferred to the pocket 15 in the direction of the arrow 47, as shown in FIG. 5. If the printed sheet 7 has been slowed to a speed of zero on the stop 16, then the corresponding lever 18 can immediately detach itself from the printed sheet 7 due to the spring action of the spring element 22 and thus continue to be moved with undiminished speed.

The end of the lever 18, on which the secondary stop 21 is mounted, has a finger-like construction, as FIG. 4 shows, and has a curved outer guide surface 45. This guide surface 45 makes it possible, by suitable control of the lever 18, to guide the rear edge 9 of a printed sheet 7 that is entering the pocket 15 in order to transfer the overlay fold 10 to one of the grippers 27. The given lever 18 does not act as a secondary stop in this case but rather acts to guide the given printed sheet 7, as just described. This process will now be described in greater detail with reference to FIG. 3.

As FIG. 3 shows, the rear edge 9 of a printed sheet 7 that has entered the pocket 15 is moved radially outward, which allows it to be gripped by one of the grippers 27. This radially outwardly directed movement basically occurs even without the guidance of a lever 18. However, the lever 18 assists this movement by the swiveling movement shown in FIG. 3. In this movement, the aforesaid guide surface 45 is moved radially outward beyond the peripheral area 17 upstream of the guide roller 41. This movement begins as soon as the corresponding cam roller 20 moves into the aforementioned area 24' of the cam 24. The guide surface 25 then briefly moves in the outward direction and then back in the inward direction. Approximately in the vicinity of the guide roller 41, the guide surface 45 is again located in the peripheral area 17.

FIG. 1 shows three printed sheets 7*a*, 7*b*, and 7*c* in different phases during the transfer from the stack 6 to the opening drums 3 and 4. A gripper 12 grips the front edge 8 of the printed sheet 7*a* approximately in the 10 o'clock position. The lever 18, whose secondary stop 21 is located in the vicinity of the front edge 8, is inactive at this time.

The front edge 8 of the printed sheet 7*b* is located at the secondary stop 21 of the lever 18". The printed sheet 7*b* has thus been slowed or is being slowed. The printed sheet 7 is guided by the supporting lever 25 and is now being transferred on the stop 21 of the lever 18" to the pocket 15. This transfer is also shown in FIG. 5. When the rear edge 9 of the printed sheet 7*b* has left the supporting lever 25, this rear edge 9 is guided by the following lever 18' in such a way, as explained above, that this rear edge 9 can be securely gripped by one of the grippers 27.

The rear edge 9 of the printed sheet 7*c* has already been gripped by a lever 27 and is being pulled by this lever 27 out of the pocket 15 by the rotational motion of the opening drum 3. Finally, the printed sheet 7*c* is opened by means that are already well known and dropped on the gathering chain 5.

The function of the lever 18' as a guide device is advantageous during the transfer of the printed sheets 7 to the opening drums but is not essential to the invention. It would thus be conceivable to have a design in which the rear edge 9 is deflected in a way that in itself is already well known and is then gripped by a gripper 27.

While specific embodiments of the invention have been shown and described in detail to illustrate the inventive principles, it will be understood that the invention may be embodied otherwise without departing from such principles.

I claim:

1. A sheet feeder for feeding printed sheets to a conveying device, the sheet feeder comprising a gripper drum having at least one gripper for removing the printed sheets one at a time from a stack; an essentially stationary pocket permanently mounted essentially in a peripheral area of the gripper drum; a stop arranged on the drum so that front fold edges of the printed sheets strike the stop, wherein the printed sheets can be aligned in the pocket against the stop with the fold forward and set down on the conveying device with reversal of direction; and a decelerating device for slowing the speed of the printed sheets downstream towards the stop, wherein the decelerating device has at least one secondary stop, which rotates in the same direction as the gripper drum, has a slower speed than the gripper drum for slowing down the printed sheets, and on which the printed sheets are slowed down upstream of the stop.

2. The sheet feeder in accordance with claim 1, wherein the secondary stop has holding means for gripping the front edge of the decelerated printed sheet.

3. The sheet feeder in accordance with claim 2, wherein the holding means have a spring element for gripping a printed sheet.

4. The sheet feeder in accordance with claim 1, wherein the secondary stop is located on a lever.

5. The sheet feeder in accordance with claim 4, wherein the lever is rotatably mounted on a driven disk.

6. The sheet feeder in accordance with claim 5, wherein two disks are provided, where a gripper disk that rotates in the same direction is arranged between the disks.

7. The sheet feeder in accordance with claim 4, wherein the lever is a two-armed lever and the secondary stop is located at the rear end of the lever.

8. The sheet feeder in accordance with claim 1, wherein the secondary stop is controlled such that, after the pocket with respect to the direction of rotation, the secondary stop is moved into a position that is shifted radially outward relative to the periphery of the gripper drum, and the secondary stop is then moved radially inward to the periphery of the gripper drum to slow down the printed sheets.

9. The sheet feeder in accordance with claim 5, wherein there are at least as many secondary stops mounted on the disk as there are grippers mounted on the gripper drum.

10. The sheet feeder in accordance with claim 1, wherein the secondary stop has a speed of rotation that is about half that of the gripper drum.

11. The sheet feeder in accordance with claim 1, comprising a cam for controlling the secondary stop.

12. The sheet feeder in accordance with claim 1, wherein the secondary stop is arranged to deflect a trailing end of the printed sheet from the periphery of the gripper drum.

13. The sheet feeder in accordance with claim 1, comprising a supporting lever that acts on the printed sheets, wherein the separating lever is assigned to an undershot conveyance area of the gripper drum.

* * * * *